US005632851A

United States Patent [19]

Young

[11] Patent Number: 5,632,851

[45] Date of Patent: May 27, 1997

[54] PORTABLE ARTICLE STRAPPING APPARATUS

[75] Inventor: Michael Young, Taipei, Taiwan

[73] Assignee: Pantech International, Inc., Taipei, Taiwan

[21] Appl. No.: 538,287

[22] Filed: Oct. 2, 1995

Related U.S. Application Data

[63] Continuation-in-part of Ser. No. 416,977, Apr. 5, 1995, abandoned.

[51] Int. Cl.[6] ..... B65B 13/32

[52] U.S. Cl. ..... 156/494; 100/29; 100/33 PB; 156/73.5; 156/502; 156/580

[58] Field of Search ..... 156/73.5, 494, 156/502, 580, 580.2; 100/29, 32, 33 PB

[56] References Cited

U.S. PATENT DOCUMENTS

| | | | |
|---|---|---|---|
| 3,442,734 | 5/1969 | Ericsson | 100/33 PB |
| 3,944,460 | 3/1976 | Karr | 100/33 PB |
| 4,272,314 | 6/1981 | Banai | 100/33 PB |
| 4,305,774 | 12/1981 | Wedeking et al. | 100/33 PB |
| 4,313,779 | 2/1982 | Nix | 100/33 PB |
| 4,450,032 | 5/1984 | Wehr | 100/33 PB |
| 4,488,926 | 12/1984 | Rauch et al. | 156/494 |
| 4,595,433 | 6/1986 | Ford et al. | 100/33 PB |
| 5,476,569 | 12/1995 | Harada | 156/502 |

*Primary Examiner*—James Sells
*Attorney, Agent, or Firm*—Bacon & Thomas

[57] ABSTRACT

A portable article strapping apparatus including a strap take-up mechanism for stretching the thermoplastic strap when the thermoplastic strap is wound around the article, a welding and cutting mechanism controlled to weld the overlapped part of the thermoplastic strap and to cut off the welded part from the thermoplastic strap, a suspension mechanism controlled to move the welding and cutting mechanism and the strap take-up mechanism between the action (operative) position and the stop (non-operative) position, and a base frame for the positioning of the aforesaid mechanisms.

9 Claims, 12 Drawing Sheets

PORTABLE ARTICLE STRAPPING APPARATUS

CROSS-REFERENCE TO RELATED APPLICATION

The present invention is a continuation-in-part of U.S. patent application Ser. No. 08/416,977, filed on Apr. 5, 1995, abandoned, entitled "PORTABLE ARTICLE STRAPPING APPARATUS".

BACKGROUND OF THE INVENTION

The present invention relates to a portable article strapping apparatus which stretches the thermoplastic strap, which is wound around the article to be packed, then welds the overlapped part of the thermoplastic strap together and cuts off the welded overlapped part from the thermoplastic strap at the same time.

A variety of packing machines have been developed for packing articles by strapping a thermoplastic strap over the article, then welding the overlapped part of the thermoplastic strap, and then cutting of the welded overlapped part from the thermoplastic strap. Examples are shown in U.S. Pat. No. 4,444,097, entitled "DEVICE FOR APPLYING AND TENSIONING A STRAPPING BAND AROUND A PACKAGE"; U.S. Pat. No. 4,254,703, entitled "ARTICLE STRAPPING METHOD AND APPARATUS"; U.S. Pat. No. 4,502,911, entitled "STRAPPING MACHINE". These packing apparatus are heavy and not movable when installed. U.S. Pat. No. 4,488,926 discloses a portable packing machine entitled "APPARATUS FOR SECURING A SYNTHETIC THERMOPLASTIC STRAP IN A BAND-LIKE FORM AROUND AN OBJECT", in which the overlapped part of the synthetic thermoplastic strap is welded together by a friction method. Similar welding process is employed in CYKLOP brand packing machine model CF 90/95 from German and STRAPEX brand packing machine Art. No. 361 from Swiss. According to U.S. Pat. No. 4,488,926, the welding mechanism, strap stretching mechanism and the strap clamping mechanism are driven a motor by means of the operation of a plurality of clutches and control switches. These complicated structure greatly increase the manufacturing cost of the machine. Another drawback of this structure of portable packing machine is its huge size. Because the friction head of the welding mechanism is controlled by a two-armed lever, the installation of the two-armed lever greatly increases the height of the machine, therefore the size of the machine cannot be reduced to the satisfactory extent. Furthermore, the swinging jaw for welding the thermoplastic strap and the clamping jaw for holding down the thermoplastic strap are separately controlled by two separate control levers and moved between the operative position and the non-operative position. Therefore, the operational procedure is complicated.

SUMMARY OF THE INVENTION

The present invention has been accomplished to provide a portable article strapping apparatus which eliminates the aforesaid drawbacks. It is therefore object of the present invention to provide a portable article strapping apparatus which is compact. It is another object of the present invention to provide a portable article strapping apparatus which is easy to operate. According to one aspect of the present invention, the portable article strapping apparatus uses a reciprocating mechanism to reciprocate the friction head over the overlapped part of the thermoplastic strap in the transverse direction, causing the overlapped part welded together. Because the friction head is reciprocated in the transverse direction, the total height of the portable article strapping apparatus can be greatly reduced. According to another aspect of the present invention, an operating arm is provided and operated to simultaneously move the ratchet wheel, which is provided for stretching the thermoplastic strap, the friction head, which is provided for welding the overlapped part of the thermoplastic strap, and the cutting device, which is provided for cutting the welded overlapped part from the thermoplastic strap, between the operative position and the non-operative position synchronously. According to still another aspect of the present invention, a safety device is installed to detect the presence of the thermoplastic strap at the welding position so as to automatically turn on/off power supply subject to the detection result.

DETAILED DESCRIPTION OF THE PREFERRED EMBODIMENT

Figure 1:
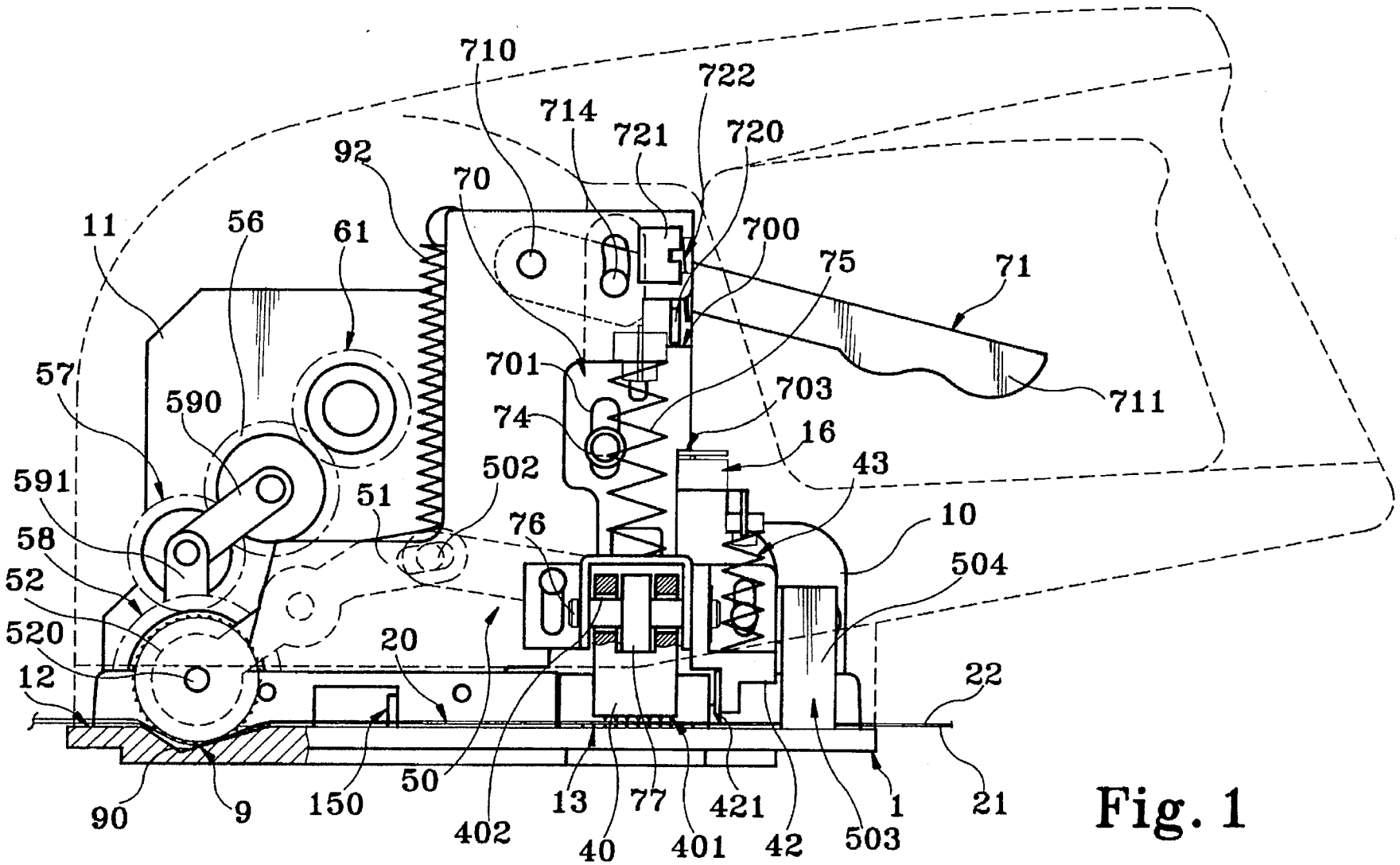
FIG. 1 is a front plain view of a portable article strapping apparatus according to the present invention, showing the strap take-up mechanism, the welding and cutting mechanism, and the suspension mechanism mounted on the base frame.
Figure 2:
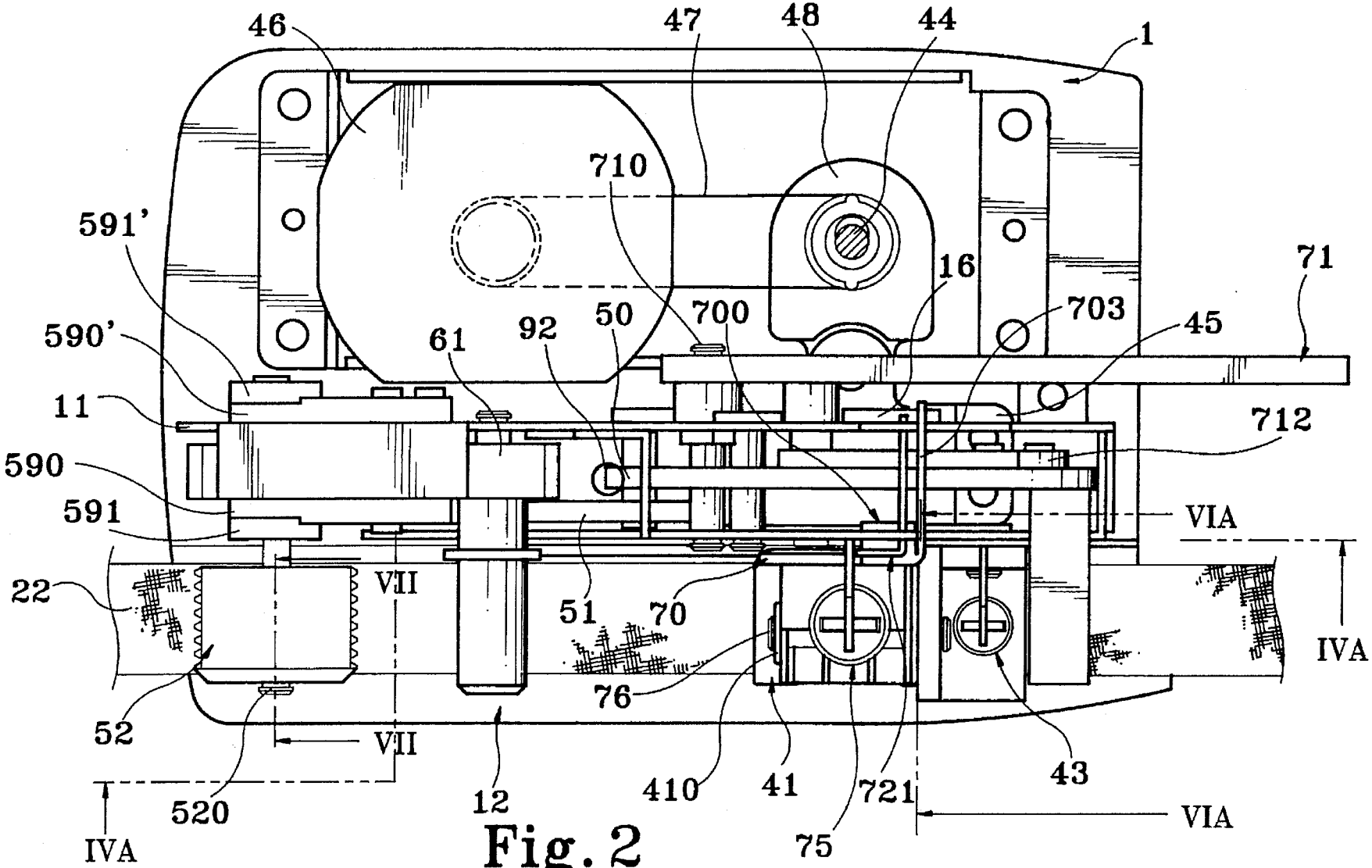
FIG. 2 is a top view of FIG. 1.
Figure 8:
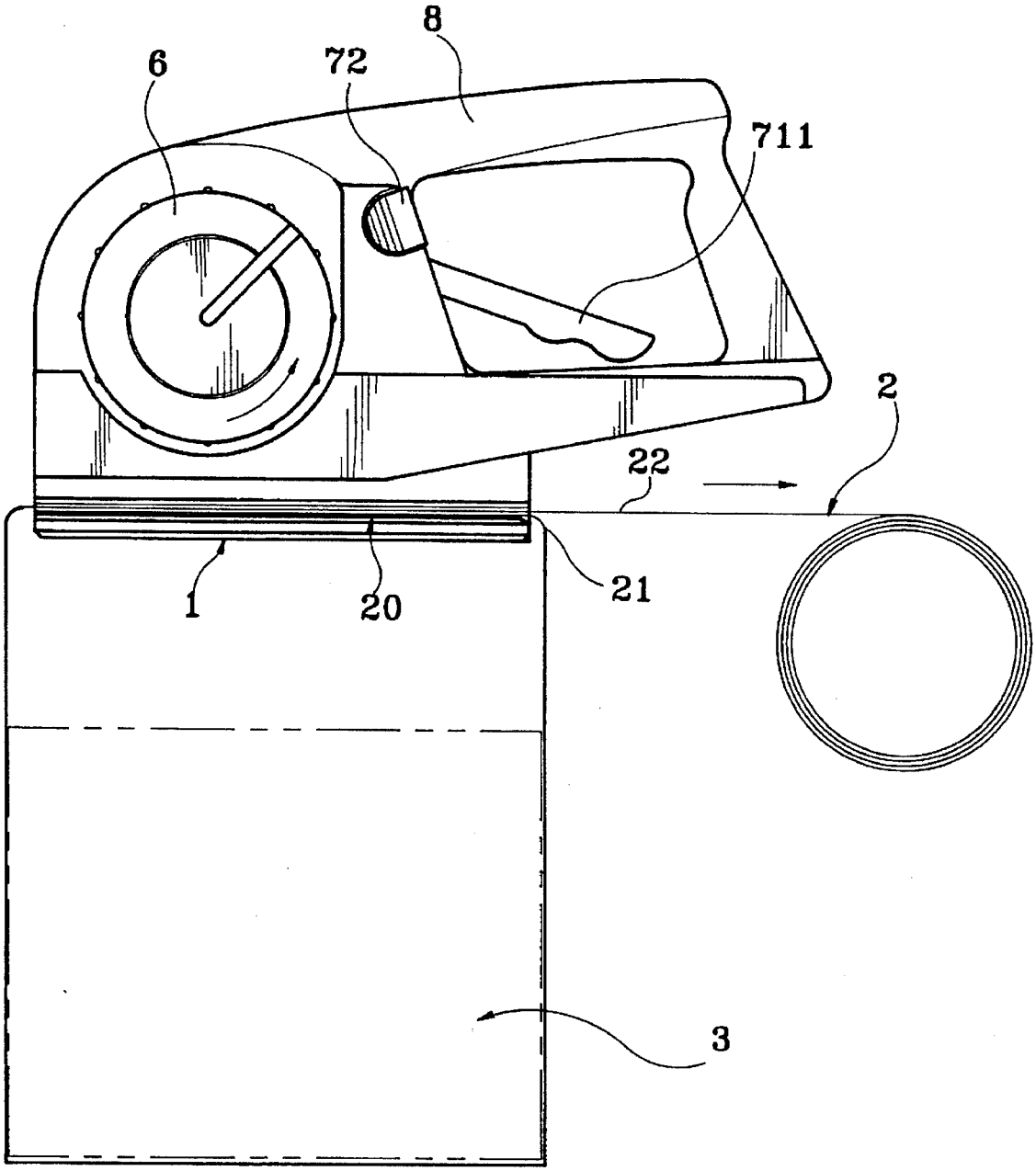
FIG. 8 is an applied view of the present invention, showing the overlapped part of the thermoplastic strap loaded on the base frame of the portable article strapping apparatus.

Referring to FIG. 1, a portable article strapping apparatus in accordance with the present invention is generally comprised of a base frame 1, a welding and cutting mechanism, a strap take-up mechanism, a suspension mechanism and a safety device respectively mounted on the base frame 1. The base frame 1 comprises a first upright side board 10 and a second upright side board 11 disposed in a parallel relation for mounting the aforesaid mechanisms, a bearing surface 12 along the foot of the first upright side board 10 for supporting the overlapped part 20 of the thermoplastic strap 2, which is wound around the article 3 (see FIG. 8). When the thermoplastic strap 2 is wound around the article 3, the overlapped part 20 is moved to the bearing surface 12 in the transverse direction (the direction of the arrow 30 shown in FIG. 6A) perpendicular to the stretching direction of the thermoplastic strap 2.

Figure 5:
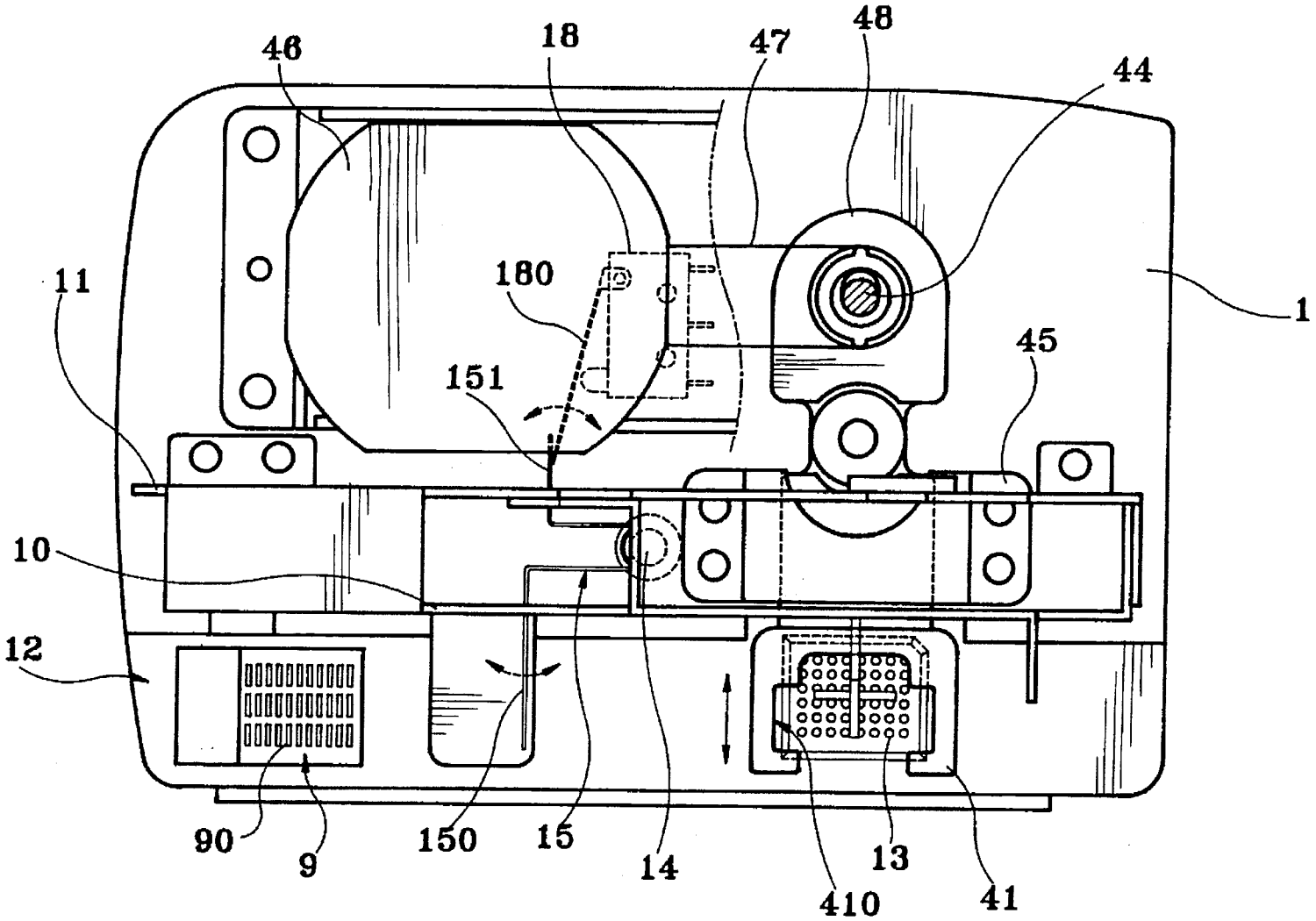
FIG. 5 is a partial view in plain of the portable article strapping apparatus shown in FIG. 1, showing the structure of the reciprocating mechanism.
Figure 7:
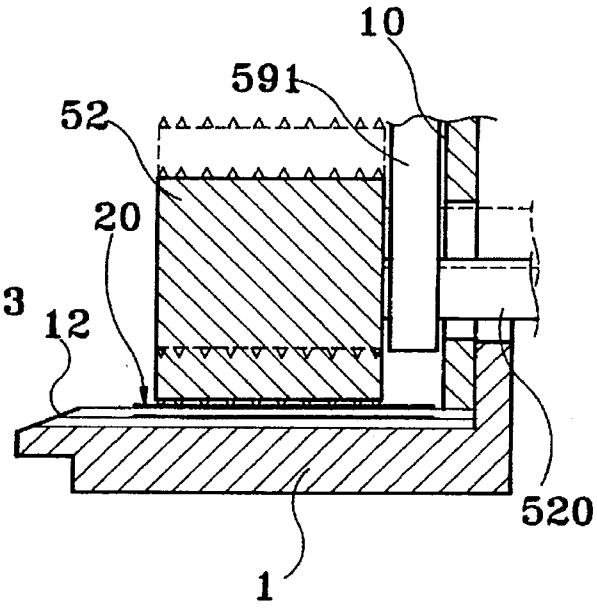
FIG. 7 is a sectional view taken along line 7A—7A of FIG. 2.
Figure 6A:
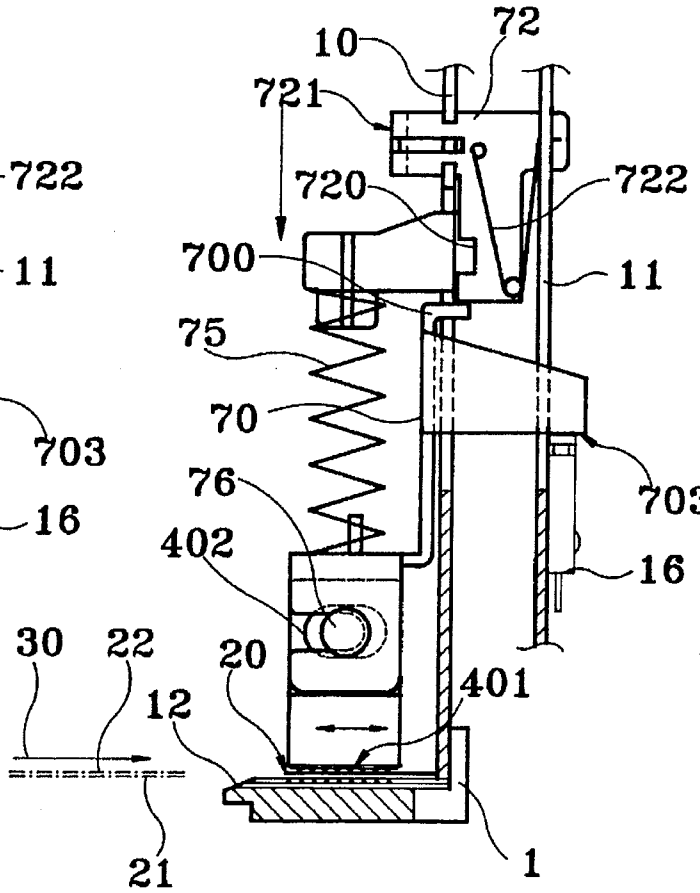
FIG. 6A is a sectional view taken along line 6A—6A of FIG. 2.

The aforesaid safety device detects the entrance of the thermoplastic strap and controls power supply subject to the detection result. As illustrated in FIGS. 1 and 5, the safety device comprises a first micro switch 18 mounted on the base frame 1, a contact member 15 turned about a pivot 14 on the base frame 1, and a second micro switch 16. The contact member 15 is a torsional spring, having a first end 151 extended to the bearing surface 12, and a second end 151 normally disposed in contact with the starting board 180 of the first micro switch 18. When the overlapped part 20 of the thermoplastic strap 2 is moved into the bearing surface 12, as shown in FIG. 6A, it forces the second end 150 of the contact member 15 to press down the starting board 180, thereby causing the power circuit of the portable article strapping apparatus turned on, i.e., the portable article strapping apparatus cannot be operated if the thermoplastic strap is not set into the packing position. The second micro switch 16 is mounted on the base frame 1 near a moving unit 70. When the moving unit 70 is lowered to the action position (see FIGS. 3A and 6A), the second micro switch 16 is triggered by the suspension arm 703 of the moving unit 70 to turn on the high-speed motor, referenced by 46, and therefore the process of welding and cutting the overlapped part 20 of the thermoplastic strap is proceeded.

The aforesaid welding and cutting mechanism comprises a friction head 40 moved relative to the cross section of the overlapped part 20 at a first position. The friction head 40 has a toothed portion 401 at the bottom. When the toothed portion 401 holds the upper strap section 22, the friction head 40 is reciprocated by the slide 41 of the reciprocating mechanism in the transverse direction 30 (see FIG. 6A) to force the upper strap section 22 against the lower strap section 21, and therefore the upper strap section 22 and the lower strap section 21 are welded together at the first position. The welding and cutting mechanism also comprises a cutting device. The cutting device comprises a cutter holder 42 synchronously moved with the friction head 40, a cutter blade 421 fastened to the cutter holder 42 for cutting the upper strap section 22, and a spring plate 43 fixed to the friction head 40 to give a downward pressure to the cutter holder 42 so that the cutter blade 421 can be moved relative to a second position on the overlapped part 20 to press on or apart from the upper strap section 22. Normally, the cutter blade 421 is forced by the spring plate 43 to move synchronously with the toothed portion 401 relative to the upper strap section 22, and the cutter blade 421 does not move relative to the base frame 1. Therefore, when the upper strap section 22 is reciprocated in the transverse direction 30, the upper strap section 22 is forced to rub the cutter blade 421, and the upper strap section 22 is cut off from the thermoplastic strap 2 as it is welded with the lower strap section 21 together. Therefore, the welding and cutting operations are simultaneously finished.

Referring to FIG. 5, the welding and cutting mechanism further comprises a reciprocating mechanism controlled to reciprocate the friction head 40 in the transverse direction 30. The reciprocating mechanism comprises a slide 41, a crank 48, a cam shaft 44, a cover 45 mounted on the base frame 1 to confine the reciprocating motion of the slide 41 in the transverse direction 30, a high-speed motor 46, and a transmission belt 47 linked between the high-speed motor 46 and the cam shaft 44. The cam shaft 44 is rotated by the high-speed motor 46 through the transmission belt 47 to turn the crank 48, causing the crank 48 to reciprocate the slide 41 at a high speed. An axle coupling may be installed to replace the transmission belt 47 for allowing the rotary output force of the high-speed motor 46 to be efficiently transmitted to the cam shaft 44. The slide 41 has a side notch 410 at one side into which the friction head 40 is inserted perpendicularly and then moved therein relative to the upper strap section 22. When the friction head 40 is inserted into the side notch 410, it can be carried by the slide 41 and reciprocated in the transverse direction.

Figure 4A:
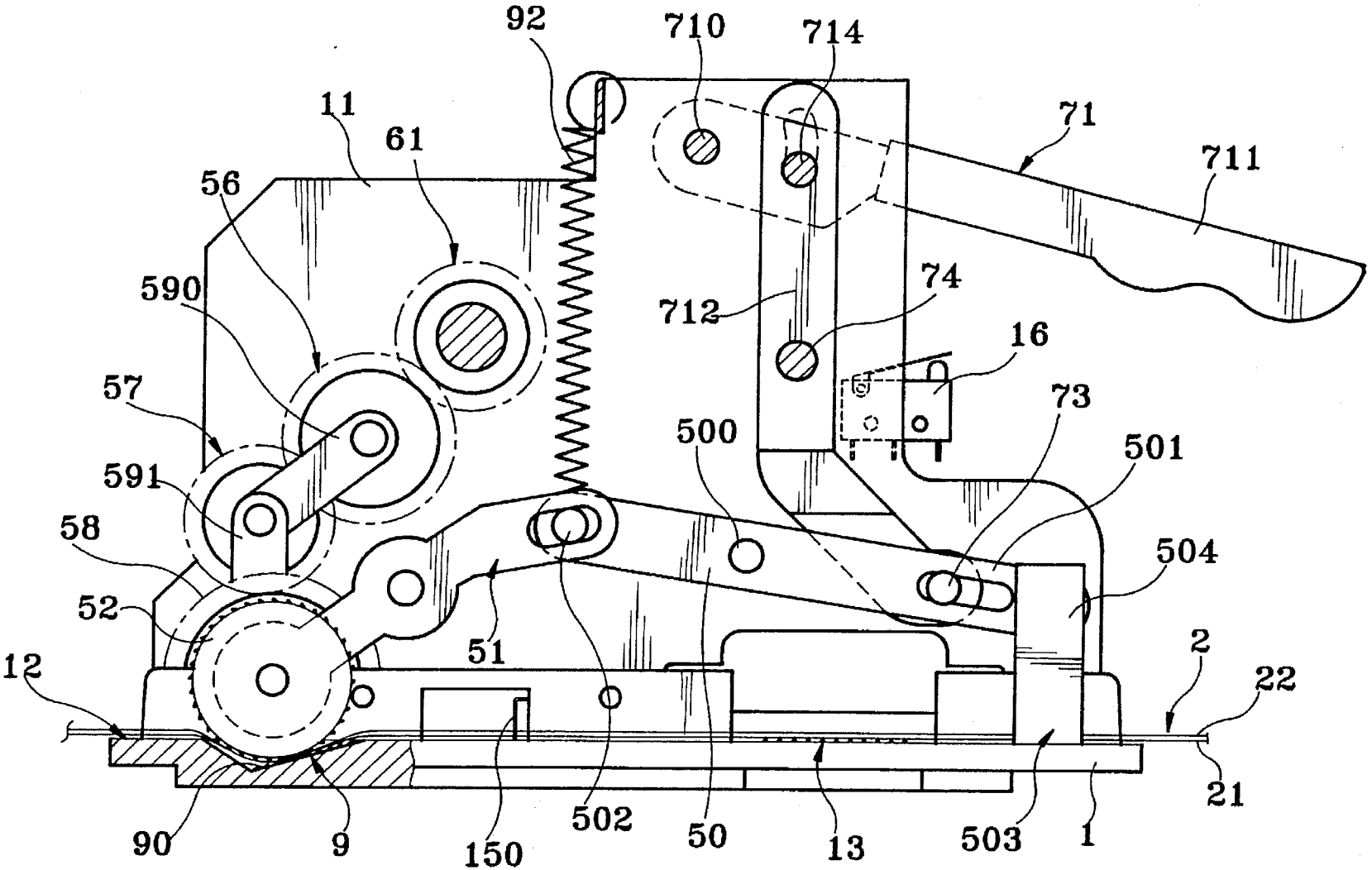
FIG. 4A is a sectional view taken along line 4A—4A of FIG. 3, showing the structure of the suspension mechanism and the strap take-up mechanism and, the ratchet wheel pressed on the overlapped part of the thermoplastic strap.
Figure 4B:
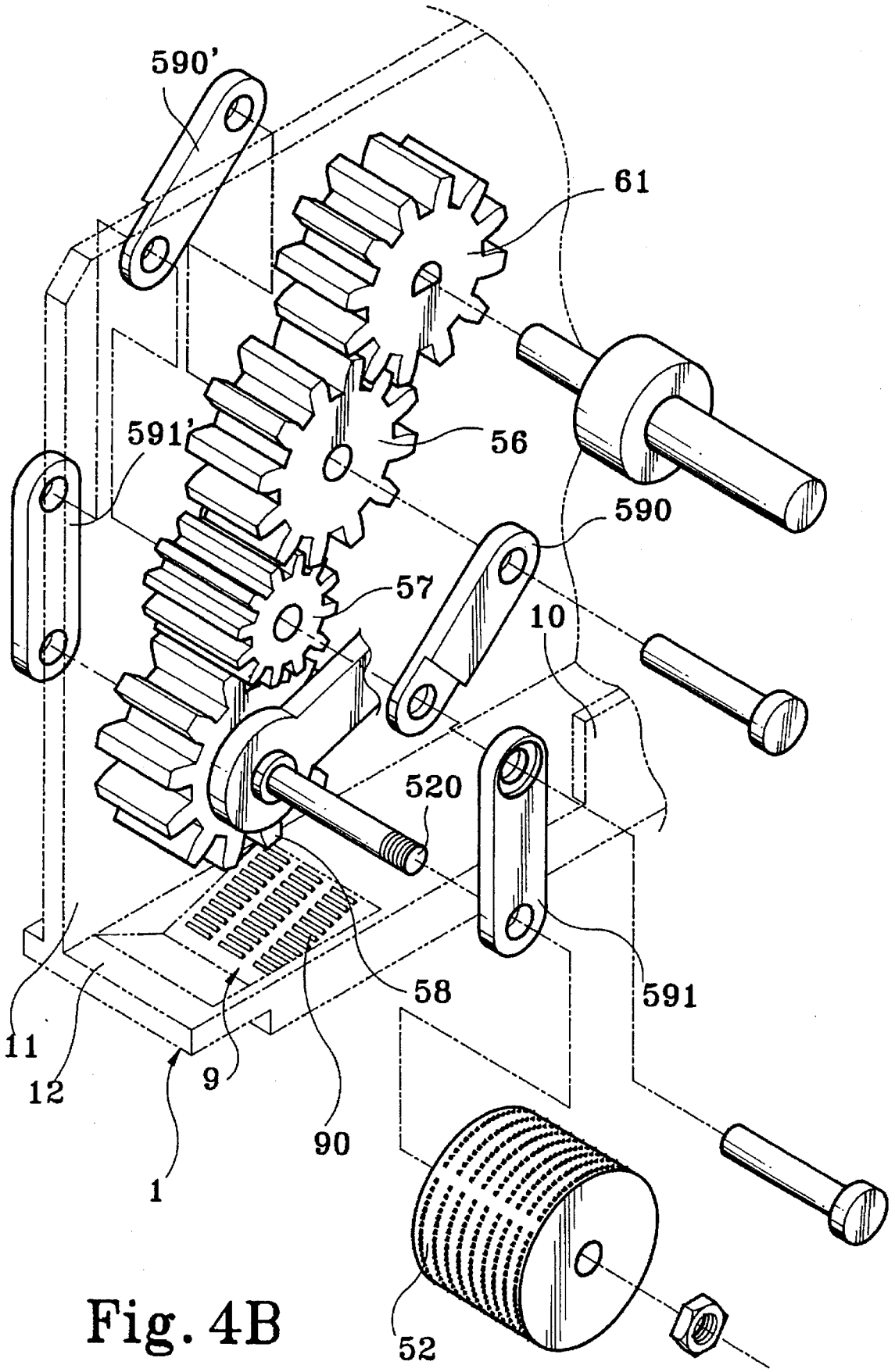
FIG. 4B shows the arrangement of the pressure mechanism of the strap take-up mechanism according to the present invention.

Referring to FIG. 4A, the strap take-up mechanism comprises a first lever 50, a second lever 51, a ratchet wheel 52 pivoted to the second lever 51, a drive gear 61 and a pressure mechanism coupled to the ratchet wheel 52. The first lever 50 and the second lever 51 are pivotably connected between the first upright side board 10 and the second upright side board 11. The first lever 50 has a center of rotation 500, an action end 501 and a coupling end 502 at two opposite ends of the center of rotation 500. The coupling end 502 is constantly pulled upwards by a spring 92. The second lever 51 has one end pivoted to the coupling end 502 of the first lever 50, and an opposite end pivoted to the ratchet wheel 52 for allowing the ratchet wheel 52 to be moved synchronously and vertically with the action end 501 of the first lever 50. Therefore, the ratchet wheel 52 is normally pressed on the overlapped part 20 at a third position (see FIG. 4A), or moved upwards from the overlapped part 20 to a released position (see FIG. 4D). A guard 503 is mounted on the action end 501 of the first lever 50, having a suspension arm 504 bridging over the bearing surface 12. Therefore, the guard 503 is moved up and down by the action end 501 of the first lever 50. When the ratchet wheel 52 is lifted, the suspension arm 504 is simultaneously lifted for permitting the thermoplastic strap 2 to be put in the bearing surface 12; on the contrary, when the ratchet wheel 52 is lowered, the suspension arm 504 is simultaneously moved downwards toward the bearing surface 12 to stop the thermoplastic strap 2 from falling out of the bearing surface 12.

The aforesaid pressure mechanism comprises a driven gear 56 mounted on the second upright side board 11 and meshed with the drive gear 61, a satellite gear 58, and a planet gear 57 meshed between the driven gear 56 and the satellite gear 58. The satellite gear 58 is fixedly mounted around the wheel shaft 520 of the ratchet wheel 52, and disposed at the end of the second lever 51. Therefore, when the user turns the hand-wheel 6 (see FIG. 8), driving power is transmitted through the drive gear 61, the driven gear 56, the planet gear 57, and the satellite gear 58 to the ratchet wheel 52, causing it to stretch the thermoplastic strap 2 tight. Furthermore, two pairs of links 590, 590'; 591, 591' are provided and linked between the respective pivot shafts of the gears 61, 56, 57, and 58 to keep the gears 61, 56, 57, and 58 meshed with one another positively. A locating device 9 is made on the bearing surface 12. The locating device 9 is a slope gradually sloping upwards towards the stretching direction of the thermoplastic strap 2, having a plurality of teeth 90 raised from the top side. When the overlapped part 20 is pressed down at the locating device 9, it is curved and engaged with the teeth 90 of the locating device 9, therefore the overlapped part 20 is firmly held down when the thermoplastic strap 2 is stretched.

Figure 3A:
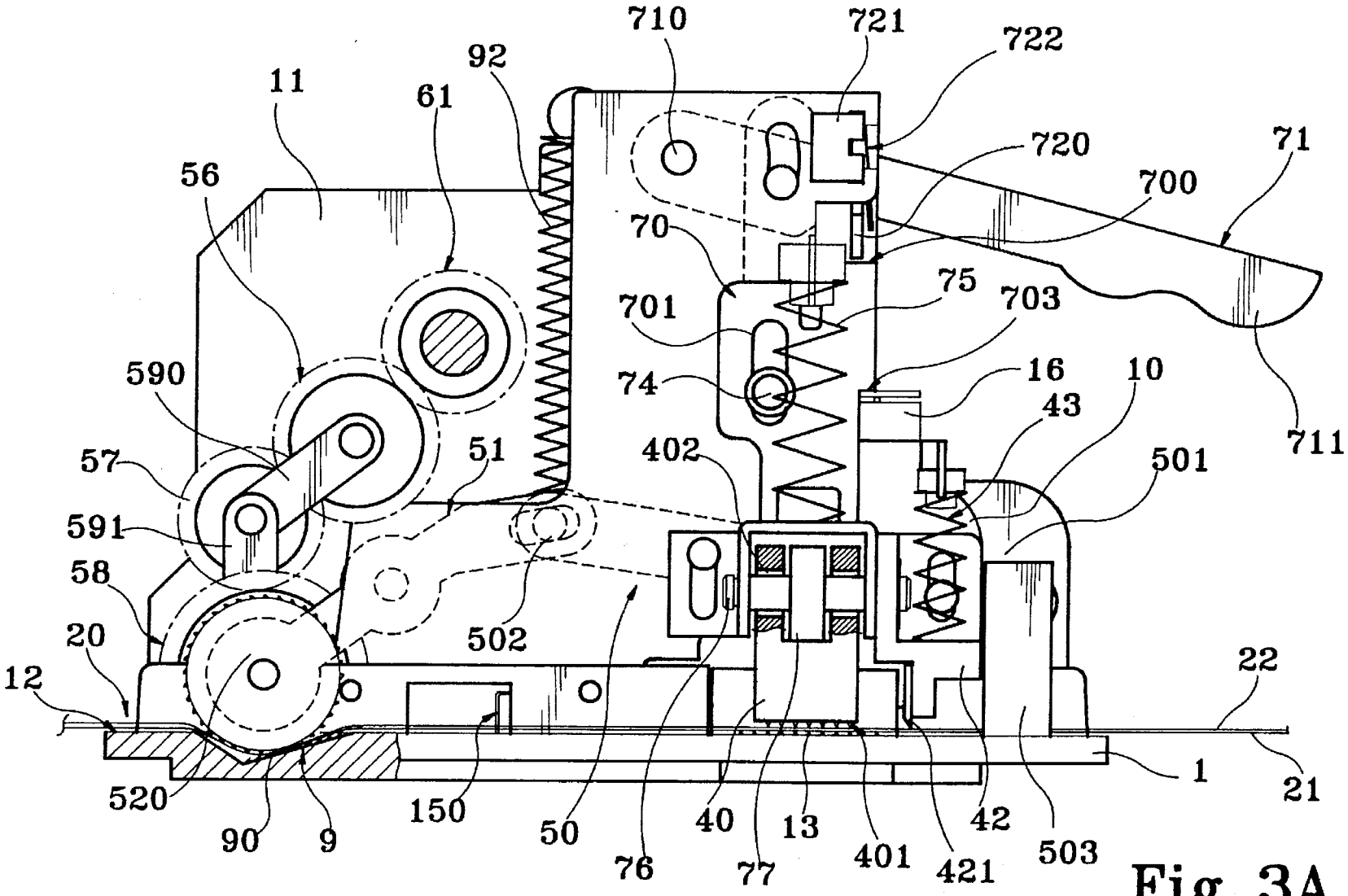
FIG. 3A is another front plain view of the portable article strapping apparatus shown in FIG. 1, showing the friction head and the cutting device pressed on the overlapped part of the thermoplastic strap.
Figure 3B:
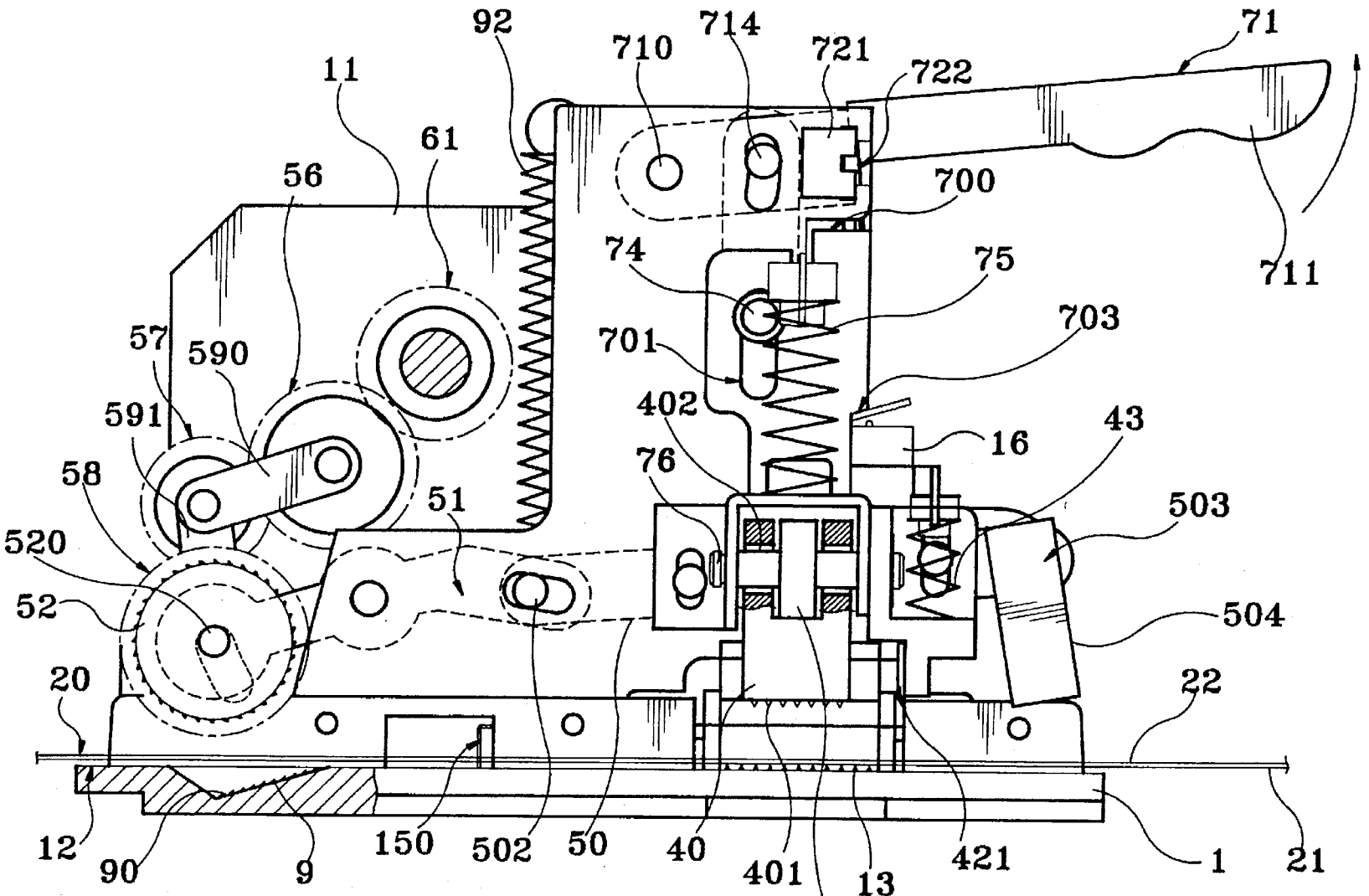
FIG. 3B is similar to FIG. 3A but showing the friction head and the cutting device released from the overlapped part of the thermoplastic strap.
Figure 6B:
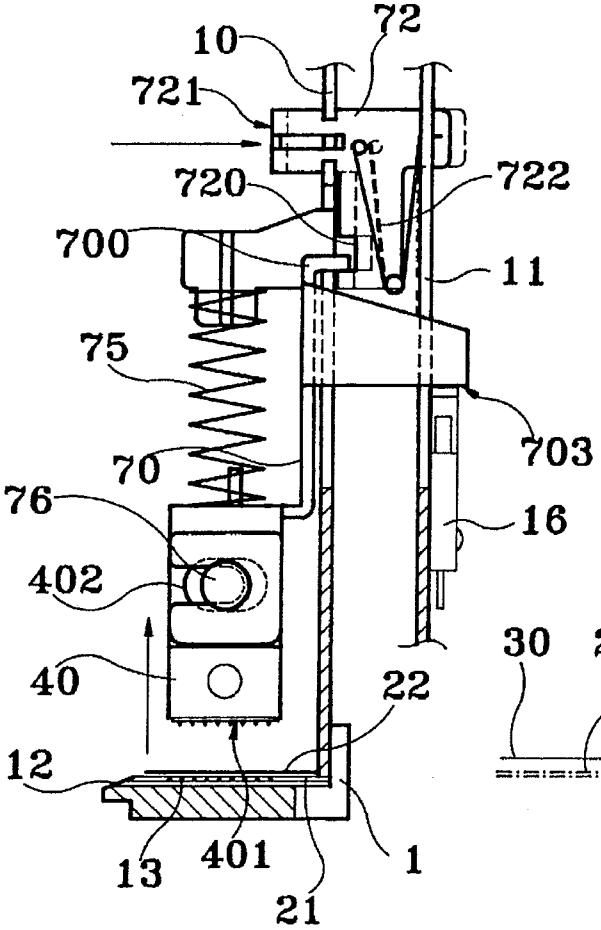
FIG. 6B is similar to FIG. 6A but showing the friction head released from the overlapped part of the thermoplastic strap.

Referring to FIGS. 3A and 4A, the suspension mechanism comprises a moving part 70 moved relative to the overlapped part 20 between a stop position (see FIG. 3B) and an action position (see FIG. 3A), an operating arm 71 controlled to move the moving part 70 to the stop position, and a retainer 72 for holding the moving part 70 at the stop position. The operating arm 71 has one end pivotably connected between the first upright side board 10 and the second upright side board 11 above the moving part 70 by a pivot 710, and an opposite end extended out of the shell 8 of the portable article strapping apparatus and terminating in a handgrip 711. A first link 712 is pivoted to the operating arm 71 between the pivot 710 and the handgrip 711. The bottom end of the first link 712 is pivoted to the action end 501 of the first lever 50 by a pivot 73. The middle part of the first link 712 is pivoted to the moving part 70 by a pivot 74. Therefore, when the user pulls the handgrip 711 of the operating arm 71 upwards, the moving part 70 and the first link 712 are lifted to move the friction head 40, which is fastened to the bottom side of the moving part 70, and the cutter blade 421 to the aforesaid stop position away from the upper strap section 22 (see FIGS. 3B and 4D). The retainer 72 is made from a thin, flat plate and inserted through mounting holes (not shown) on the first upright side board 10 and the second upright side board 11, comprising a hooked portion 720 for hooking by a projecting portion 700 on the moving part 70 when the moving part 70 is lifted and stopped at the aforesaid stop position. A torsional spring 722 is provided to keep the hooked portion 720 of the retainer 72 in position for hooking by the projecting portion 700 of the moving part 70. When the user moves the release end 721 of the retainer 72 downwards towards the first upright side board 10 (see FIG. 6B), the hooked portion 720 is released from the projecting portion 700, and the moving part 70 will then be forced by a spring 75 back to the action position as shown in FIGS. 3A and 6A, causing the friction head 40 and the cutter blade 421 pressed on the upper strap section 22. The aforesaid pivot 74 can be moved vertically in an oblong hole 701 on the moving part 70. When the moving part 70 is moved by the pivot 74 to the upper limit in the oblong hole 701 and retained in place by the retainer 72, the first link 712 can still be moved downwards along the oblong hole 701 without affecting the return stroke of the ratchet wheel 52 to press on the upper strap section 22 (see FIG. 4A).

The aforesaid friction head 40 has a through hole 402 disposed in parallel with the thermoplastic strap stretching direction for mounting the moving part 70. The moving part 70 has an axle 76 fastened to the through hole 402 on the friction head 40. The width of the through hole 402 relative to the transverse direction 30 and the cross section of the overlapped part 20 is wider than the diameter of the axle 76, so that the axle 76 does not hinder the movement of the friction head 40 in the transverse direction. Furthermore, the axle 76 is mounted with a rotary wheel 77. When the moving part 70 is moved upwards, the friction head 40 will be lifted by the axle 76 (at this stage, the rotary wheel 77 is not pressed on the friction head 40); when the moving part 70 is moved downwards, the rotary wheel 77 will be forced by the spring 75 to press the friction head 40 against the upper strap section 22. When the friction head 40 is reciprocated, the rotary wheel 77 is turned over the friction head 40 without causing much noise or vibration.

The operation of the portable article strapping apparatus includes four steps outlined hereinafter.

Figure 4C:
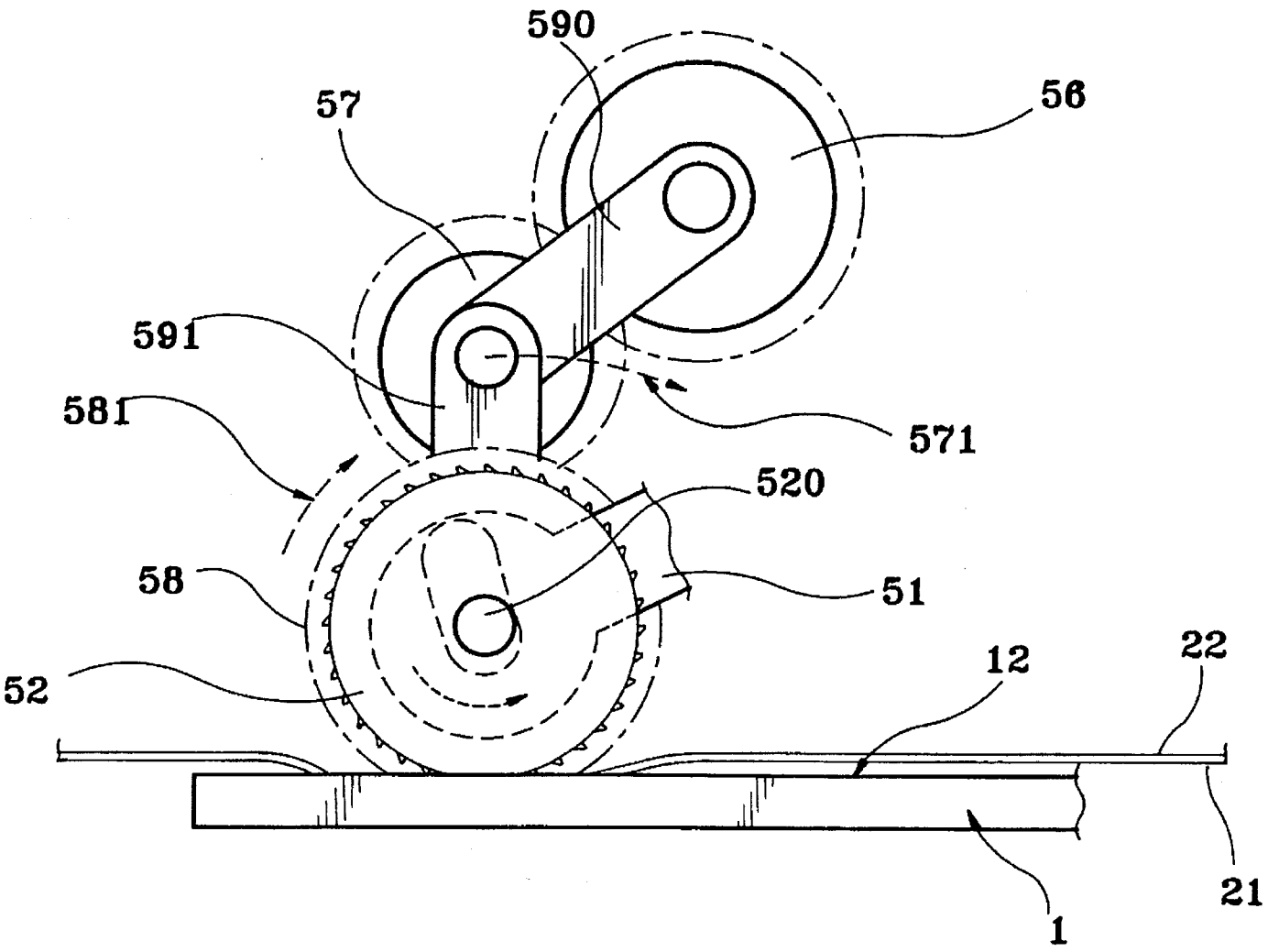
FIG. 4C shows the pressure mechanism of the strap take-up mechanism operated, and the thermoplastic strap stretched by the ratchet wheel.
Figure 4D:
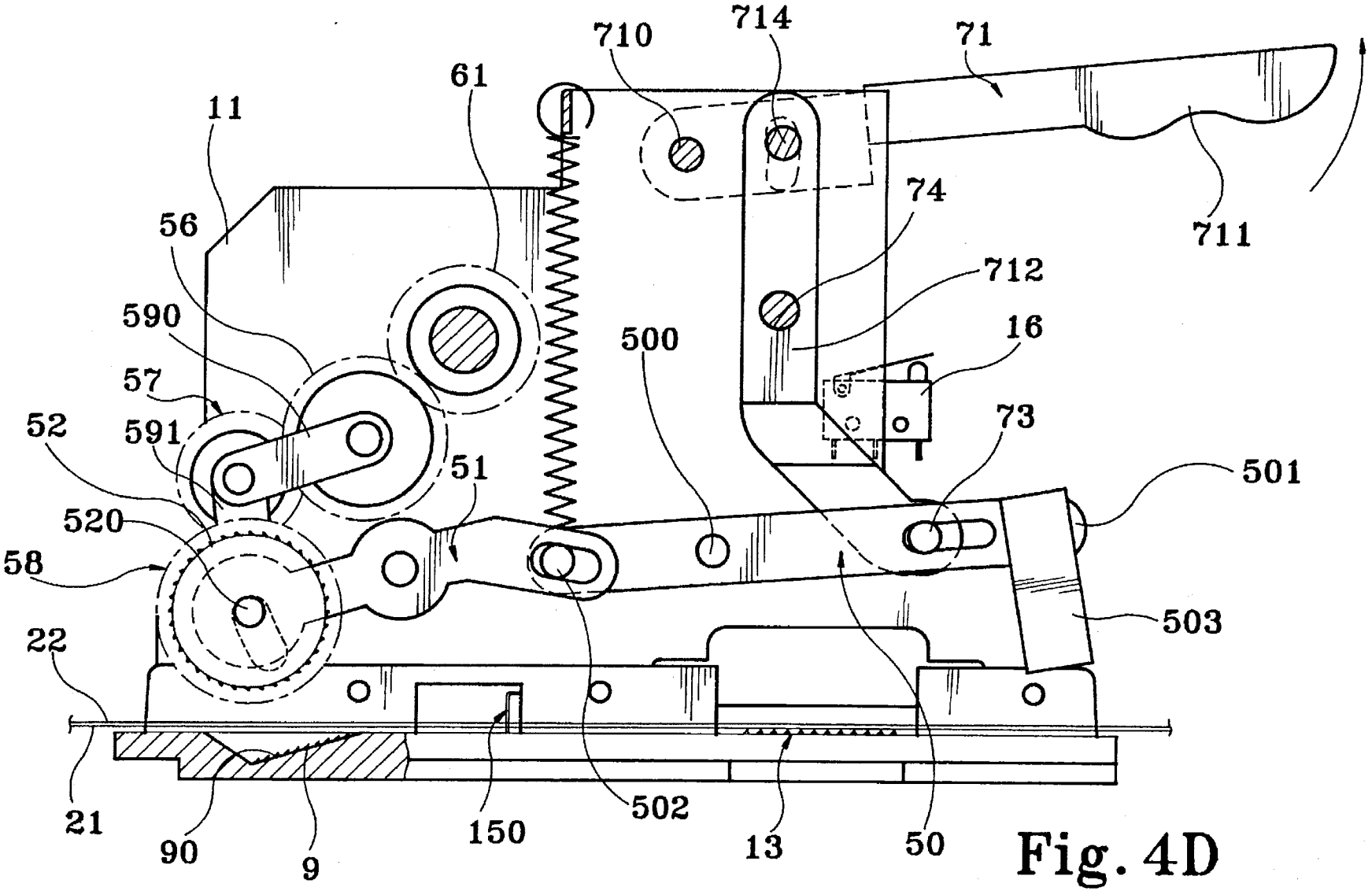
FIG. 4D is similar to FIG. 4A but showing the ratchet wheel moved to the release position.
Figure 9:
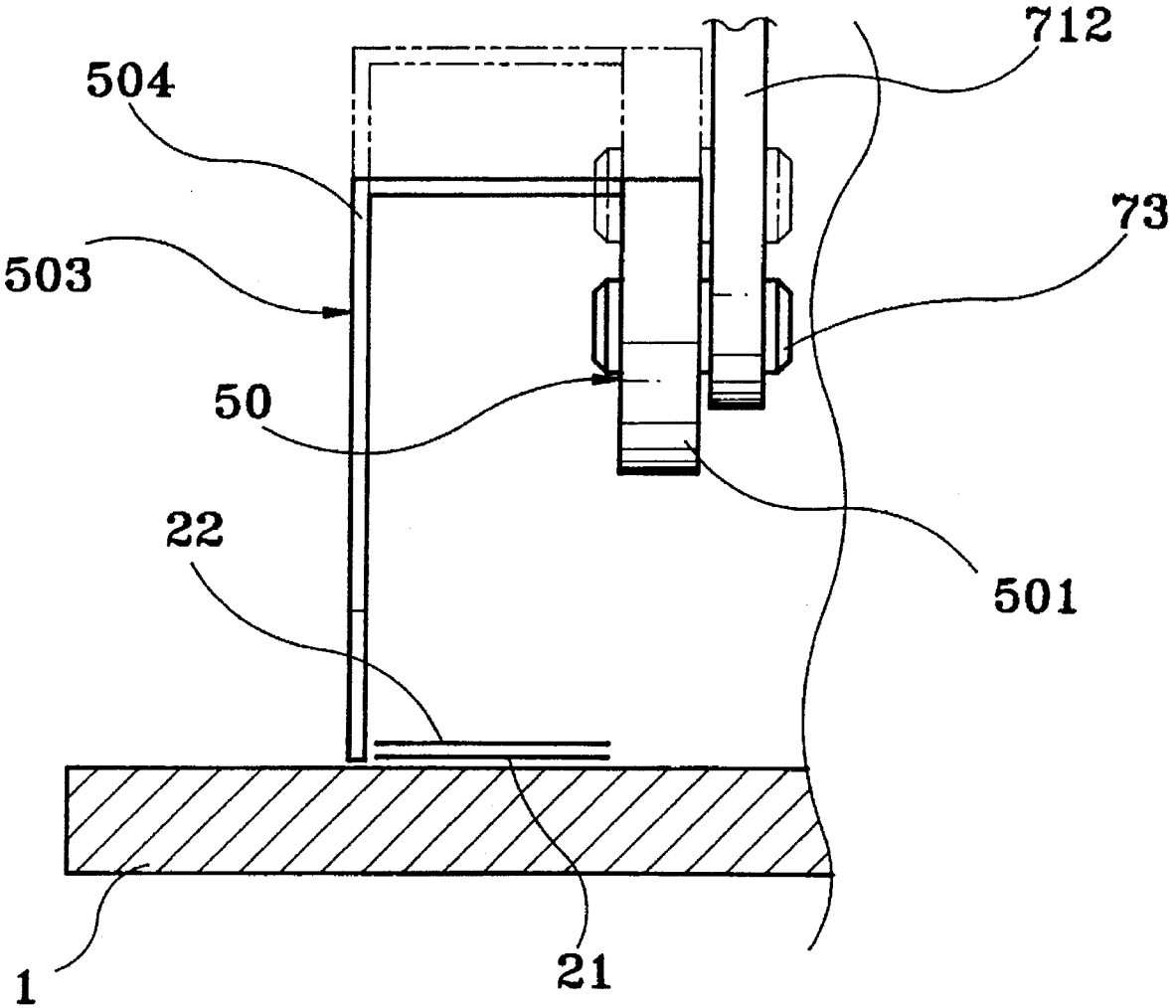
FIG. 9 is a partial sideview of FIG. 4A, showing the up and down positions of the guard of the portable article strapping apparatus.

1) The handgrip 711 of the operating arm 71 is pulled upwards to lift the ratchet wheel 52 away from the upper strap section 22 (see FIG. 4D). When the handgrip 711 is lifted, the moving part 70 is driven to move the friction head 40 and the cutter blade 421 away from the upper strap section 22, and then retained in the aforesaid stop position by the retainer 72 (see FIGS. 3B and 4D). At the same time, the suspension arm 504 is lifted to the position shown in the dotted lien in FIG. 9, so that the overlapped part 20 of the thermoplastic strap 2 can be put in the bearing surface 12 between the ratchet wheel 52 and the locating device 9 (see FIG. 8).

2) When the overlapped part 20 is put into position, the handgrip 711 is released, permitting the ratchet wheel 52 to be lowered and pressed on the overlapped part 20 against the locating device 9, and at the same time the suspension arm 504 is lowered to the bearing surface 12 to stop the overlapped part 20 from falling out of the bearing portion 12.

3) The hand-wheel 6 is then turned by hand to stretch the upper strap section 22 by means of the ratchet wheel 52. When the upper strap section 2 is stretched tight, the satellite gear 58 is forced by a reaction force 581 against its revolving direction (see FIG. 4C), to turn the planet gear 57 toward the direction of the arrow 571 shown in FIG. 4C, therefore the downward pressure to the satellite gear 58 is increased. At the same time, the bottom side of the lower strap section 22 is engaged with the teeth 90 of the locating device 9.

4) The release end 721 of the retainer 72 is then depressed to force the toothed portion 401 of the friction head 40 and the cutter blade 421 against the upper strap section 22 of the overlapped part 20 at the first position and the second position respectively, then the second micro switch 16 is turned on to start the high-speed motor 46, causing the friction head 40 reciprocated in the transverse direction 30 for few seconds, and therefore the upper strap section 22 and the lower strap section 21 are welded together and, the cutter blade 421 simultaneously cuts off the upper strap section 22 from the thermoplastic strap 2. After the strapping process, the handgrip 711 is lifted again so that the overlapped part 20 can be moved away from the bearing surface 12. When the handgrip 711 is lifted, the friction head 40 and the cutter blade 421 are simultaneously moved away from the thermoplastic strap 2. The length of operation time of the high-speed motor 46 is controlled by a timer circuit (not shown), i.e., the welding time can be set through the timer circuit subject to the material of the thermoplastic strap used.

I claim:

1. A portable article strapping apparatus for stretching a thermoplastic strap being wound around an article, then welding the lower strap section and upper strap section of the overlapped part of the thermoplastic strap and simultaneously cutting off the welded overlapped part from said thermoplastic strap, the apparatus comprising a base frame for bearing said overlapped part and for allowing said overlapped part to be loaded into position only in a transverse direction perpendicular to the stretching direction of said thermoplastic strap, a strap take-up mechanism spaced above said overlapped part for taking up said thermoplastic strap, a welding and cutting mechanism disposed above said overlapped part, and a suspension mechanism, wherein:

said welding and cutting mechanism comprises a friction head moved relative to a first position on said overlapped part, a cutting device moved relative to a second position on said overlapped part, and a reciprocating mechanism controlled to reciprocate said friction head in said first position along said transverse direction, said friction head and said cutting device being synchronously moved between the operative position pressed on said overlapped part and the non-operative position away from said overlapped part;

said base frame comprises a toothed portion for holding the lower strap section of said overlapped part from being moved in said transverse direction and the stretching direction of said thermoplastic strap;

said strap take-up mechanism comprises a lever set, a ratchet wheel having a wheel shaft pivoted to said lever set and pressed on said overlapped part and controlled to stretch said thermoplastic strap, and a pressure mechanism coupled to the wheel shaft of said ratchet wheel and controlled to give it a downward pressure when said ratchet wheel is pressed on said overlapped part, said lever set being operated to move said ratchet wheel away from said overlapped part to a release position;

said suspension mechanism comprises a moving part moved relative to said overlapped part between a stop position and an action position, a retainer for holding said moving part in said stop position, and an operating arm for moving said moving part to said stop position and said lever set to said release position simultaneously, said friction head and said cutting device being moved away from said overlapped part by said moving part when said moving part is moved to said stop position, said friction head and said cutting device being pressed on said overlapped part when said moving part is moved to said action position.

2. The portable article strapping apparatus of claim 1 wherein said reciprocating mechanism comprises a motor mounted on said base frame, a slide reciprocated on said base frame in said transverse direction, a crank controlled to reciprocate said slide, a transmission belt, a cam shaft coupled to said motor by said transmission belt and driven by said motor through said transmission belt to turn said crank, said slide having a side notch, into which said friction head is inserted perpendicularly and then moved therein relative to said first position on said upper strap section.

3. The portable article strapping apparatus of claim 1 wherein said friction head has a toothed portion at a bottom side thereof for holding said upper strap section and moving it in said transverse direction, permitting said upper strap section to be welded to said lower strap section and the cut away from said thermoplastic strap by said cutting device.

4. The portable article strapping apparatus of claim 1 wherein said cutting device comprises a cutter holder synchronously moved with said friction head, a cutter blade mounted on said cutter holder and moved to cut off said upper strap section from said thermoplastic strap, and a spring plate to force said cutter blade into contact with said upper strap section, said cutter blade being forced by said spring plate against said upper strap section and maintained immovable relative to said base frame so that said upper strap section can be cut off from said thermoplastic strap when it is stretched against said cutter blade.

5. The portable article strapping apparatus of claim 1 wherein said lever set comprises a first lever and a second lever, said first lever comprising a center of rotation, an action end and a coupling end at two opposite ends of said center of rotation, said action end of said first lever being moved up and down by said operating arm, causing said coupling end to move in the reversed direction, said second lever having one end pivoted to said coupling end of said first lever and an opposite end pivoted to said ratchet wheel for allowing said ratchet wheel to be moved between said release position and said overlapped part.

6. The portable article strapping apparatus of claim 1 wherein said pressure mechanism comprises a drive gear turned by hand, a driven gear meshed with said drive gear, a satellite gear, and a planet gear meshed between said driven gear and said satellite gear, said satellite gear being fixedly mounted around the wheel shaft of said ratchet wheel.

7. The portable article strapping apparatus of claim 1 wherein said aforesaid friction head has a through hole disposed in parallel with the thermoplastic strap stretching direction for mounting said moving part, said moving part comprising an axle fastened to said through hole on said friction head, a rotary wheel mounted around said axle, said friction head being lifted by said axle when said moving part is moved upwards, said rotary wheel being forced to press said friction head against said upper strap section when said moving part is moved downwards.

8. The portable article strapping apparatus of claim 6 wherein the width of said through hole of said friction head relative to the transverse direction and the cross section of said overlapped part is wider than the diameter of said axle, so that said axle does not hinder the reciprocating movement of said friction head in said transverse direction.

9. The portable article strapping apparatus of claim 1 wherein said moving part of said suspension mechanism comprises a spring for forcing said friction head against said overlapped part.

* * * * *